US005748212A

United States Patent [19]

Takagi

[11] Patent Number: 5,748,212

[45] Date of Patent: May 5, 1998

[54] IMAGE FORMING APPARATUS HAVING A CHARGED PARTICLE CONTROL DEVICE WITH A SELECTIVELY INSULATING ARRANGEMENT

[75] Inventor: Osamu Takagi, Nagoya, Japan

[73] Assignee: Brother Kogyo Kabushiki Kaisha, Nagoya, Japan

[21] Appl. No.: 262,493

[22] Filed: Jun. 20, 1994

[30] Foreign Application Priority Data

Aug. 19, 1993 [JP] Japan ..... 5-204933

[51] Int. Cl.[6] ..... B41J 2/06

[52] U.S. Cl. ..... 347/55

[58] Field of Search ..... 347/55, 112, 151, 347/123, 120; 355/261, 262

[56] References Cited

U.S. PATENT DOCUMENTS

| | | | |
|---|---|---|---|
| 3,689,935 | 9/1972 | Pressman et al. | 347/55 |
| 4,743,926 | 5/1988 | Schmidlin et al. | 347/55 |
| 4,755,837 | 7/1988 | Schmidlin et al. | 347/55 |
| 4,780,733 | 10/1988 | Schmidlin | 347/55 |
| 4,814,796 | 3/1989 | Schmidlin | 347/55 |
| 4,912,489 | 3/1990 | Schmidlin | 347/55 |
| 5,036,341 | 7/1991 | Larsson | 347/55 |
| 5,200,769 | 4/1993 | Takemura et al. | 347/55 |

FOREIGN PATENT DOCUMENTS

| | | |
|---|---|---|
| 587 366 | 3/1994 | European Pat. Off. . |
| 6-155798 | 6/1994 | Japan . |

*Primary Examiner*—Benjamin R. Fuller
*Assistant Examiner*—Charlene Dickens
*Attorney, Agent, or Firm*—Oliff & Berridge, PLC

[57] ABSTRACT

According to an image forming apparatus, wiring portions of control electrodes of an aperture electrode unit are disposed at a farther position away from a toner carry roller than operating portions of the control electrodes. So, toner on the toner carry roller can be prevented from repetitively attaching to and detaching from an insulating sheet of the aperture electrode unit. Therefore, stable toner flow can be produced. Thus, a delicate image can be output from the image forming apparatus.

30 Claims, 6 Drawing Sheets

IMAGE FORMING APPARATUS HAVING A CHARGED PARTICLE CONTROL DEVICE WITH A SELECTIVELY INSULATING ARRANGEMENT

BACKGROUND OF THE INVENTION

1. Field of the Invention

This invention relates to an image forming apparatus with an aperture electrode unit having plural apertures for use in a reproduction device, such as a copying machine, a printer, a plotter, or a facsimile machine.

2. Description of Related Art

Known image forming apparatus form an image using an aperture electrode unit having plural apertures. In this image forming apparatus, a voltage is selectively applied to the aperture electrode unit in accordance with image data to control toner particles to selectively pass through the apertures. The toner particles that can pass through the apertures of the aperture electrode unit form an image on a image forming medium (supporter). This type of image forming apparatus is disclosed in U.S. Pat. No. 3,689,935.

The aperture electrode unit includes an insulating flat plate, a reference electrode, plural control electrodes and plural apertures. The reference electrode is continuously formed on one side surface of the flat plate. The control electrodes are formed on the other side surface of the flat plate and are electrically insulated from one another. The apertures are formed in correspondence with the respective control electrodes to penetrate through the flat plate, the reference electrode and the control electrodes and are arranged on at least one row in a longitudinal direction of the aperture electrode unit.

The image forming apparatus further includes a voltage supply means, a toner supply means, and a positioning means. The voltage supply means serves to selectively supply a voltage across the control electrodes and the reference electrode of the aperture electrode unit on the basis of the image data. The toner supply means serves to supply charged toner particles to the lower side of the aperture electrode unit so that the flow of the toner particles passing through the apertures is modulated in accordance with the potential applied to the aperture electrode unit. The positioning means serves to feed and position the supporter so as to be movable in a particle-flowing path relatively to the aperture electrode unit.

Further, U.S. Pat. Nos. 4,743,926, 4,755,837, 4,780,733 and 4,814,796 disclose a first type of image forming device in which the reference electrode of the aperture electrode unit is disposed at the toner supply means side while the control electrodes are disposed at the supporter side on which the image is formed.

On the other hand, U.S. Pat. No. 4,912,489 discloses a second type of image forming apparatus in which the control electrodes of the aperture electrode are disposed at the toner supply means side while the reference electrode of the aperture electrode unit is disposed on the supporter side on which the image is formed. As described in this U.S. patent, with this construction, the second type of image forming apparatus can reduce a voltage to be applied to the control electrodes at an off time to about a quarter of that of the first type of image forming apparatus.

Here, the term of "off time" means a time when no toner particle is attached onto the supporter, that is, a time when a blank portion of an image is formed. Inversely, the term of "on time" means a time when a toner image is formed on the supporter. In the conventional aperture electrode unit as described above, the reference electrode is disposed on one side surface of the flat plate while the plural control electrodes are disposed on the other side of the flat plate, and an electric field is formed between the control electrodes and the reference electrode. Therefore, a strong electric field must be applied between these electrodes to control charged toner that will be supplied in the vicinity of the aperture electrode unit from the toner supply means. To form such a strong electric field between the control electrodes and the reference electrode, a voltage supply means capable of applying a high voltage is required, and a total cost of the apparatus necessarily rises up.

In view of the foregoing, the applicant of this application has proposed an image forming apparatus as disclosed in the specification and drawings of Japanese Patent Application No. 4-254494. This image forming apparatus has an aperture electrode unit 100 that can control toner particles even at a low voltage, as shown in FIG. 9. The aperture electrode 100 includes a flat plate 102 of 25 μm thickness formed of insulating material, plural control electrodes 104 of 1 μm thickness insulated from one another, and plural apertures 106. The control electrodes 104 are formed on only one side of the flat plate 102. Each of the control electrodes 104 comprises an operating portion 104A provided to surround each aperture 106, and a wiring portion 104B (non-operating portion) provided to extend from each aperture 106 to one end portion of the flat plate 102. The aperture 106 is provided in correspondence with each control electrode 104 to penetrate through the control electrode 104 and the flat plate 102. The apertures 106 have substantially 40 μm diameter and are formed in a row in the longitudinal direction of the flat plate 102.

The aperture electrode unit 100 is slightly pressed against a toner carry roller (not shown) to contact the toner carry roller, and a voltage is applied across the control electrodes 104 and the toner supply roller. In a case where the aperture electrode unit 100 thus constructed is applied to an image forming apparatus, upon applying a control voltage to the control electrodes 104, an electric field is formed between the control electrodes 104 and the toner carry roller on which charged toner is carried. So, a toner flow occurs between the control electrodes 104 and the toner supply roller. Accordingly, as compared to the image forming apparatus as described above, the toner flow can be controlled with an extremely low voltage. At this time, in the vicinity of a contact portion between the aperture electrode unit 100 and the toner carry roller, the toner on the toner carry roller can pass through the apertures 106 by the electric field formed through the flat plate 102 between the operating portion 104A of the control electrodes 104 and the toner carry roller.

In this case, however, an electric field is also formed between the wiring portions 104B of the control electrodes 104 and the toner carry roller. Thus, there occurs a phenomenon that the toner is electrostatically attracted and attached to the flat plate 102. The toner attached to the flat plate 102 is deposited in a gap between the control electrodes 104 and the toner carry roller so that the electric field for producing the toner flow becomes weaker as the gap distance between the control electrodes 104 and the toner carry roller is increased due to the deposition of the toner. Particularly in a case where the toner is attached to the flat plate 102 in such an arrangement that the wiring portions 104B of the control electrodes 104 are disposed upstream of the rotational direction of the toner carry roller, a supply amount of toner to the apertures 106 temporarily lacks by an amount corresponding to the attached toner to the flat plate 102 when sequential dots are printed as an image on the supporter. Thus, there occurs a problem that the formed image is blurred. Conversely, when a non-control voltage is applied to the control electrodes inducing the attachment of the toner to prevent occurrence of the toner flow, the electric field formed between the control electrodes 104 and the toner carry roller by the control voltage, that is, the electric field for passing the toner through the apertures 106 and the electric field for attaching the toner to the flat plate 102, is extinguished. At this time, the toner attached to the flat plate 102 is returned onto the toner carry roller and carried thereon. Accordingly, the toner carry amount on the toner carry roller is locally increased by an amount of the returned toner. Thus, a portion of the toner carry roller carries the toner non-uniformly. Therefore, when the control voltage is applied to the control electrodes 104 to produce a toner flow when the toner on this portion is supplied to the apertures 106, the toner is excessively supplied to the apertures to thereby induce excessive increase of the toner flow amount. Alternatively, a phenomenon is created that causes the toner to jump out from the apertures 106 even when the non-control voltage is applied. As a result, the toner is liable to be attached to a non-image forming portion on the supporter. Thus, an image cannot be formed with high image quality. Further, when the toner is repetitively attached to the flat plate and returned therefrom to the toner carry roller in the vicinity of the wiring portions 104B of the control electrodes 104, the distance between the control electrodes 104 and the toner carry roller fluctuates at all times. So, the electric field for producing the toner flow becomes unstable.

SUMMARY OF THE INVENTION

An object of this invention is to provide an image forming apparatus having excellent controllability of toner existing at the toner supply means side and that performs image formation with high image quality.

To attain the above and other objects, an image forming apparatus according to this invention includes toner flow control means having control electrodes for controlling flow of charged toner, toner supply means for supplying the charged toner to the toner flow control means, and voltage supply means for applying a control voltage to the control electrodes to form an electric field for controlling the flow of the charged toner. Further, each of the control electrodes comprises an operating portion and a non-operating portion. Only the operating portion contributes to the formation of the electric field for controlling the toner flow when the control voltage is applied to the control electrodes by the voltage supply means.

According to the image forming apparatus of this invention thus constructed, when the control voltage is applied to the control electrodes by the voltage supply means, only the operating portions of the control electrodes contribute to the formation of the electric field for controlling the toner flow. Accordingly, the charged toner supplied from the toner flow control means can be prevented from repetitively attaching to and separating from the toner flow control means. Thus, stable toner flow can be produced, so that a delicate image can be formed with high image quality.

BRIEF DESCRIPTION OF THE DRAWINGS

Preferred embodiments of the present invention are described in detail with reference to the following figures wherein.

DETAILED DESCRIPTION OF PREFERRED EMBODIMENTS

Figure 1:
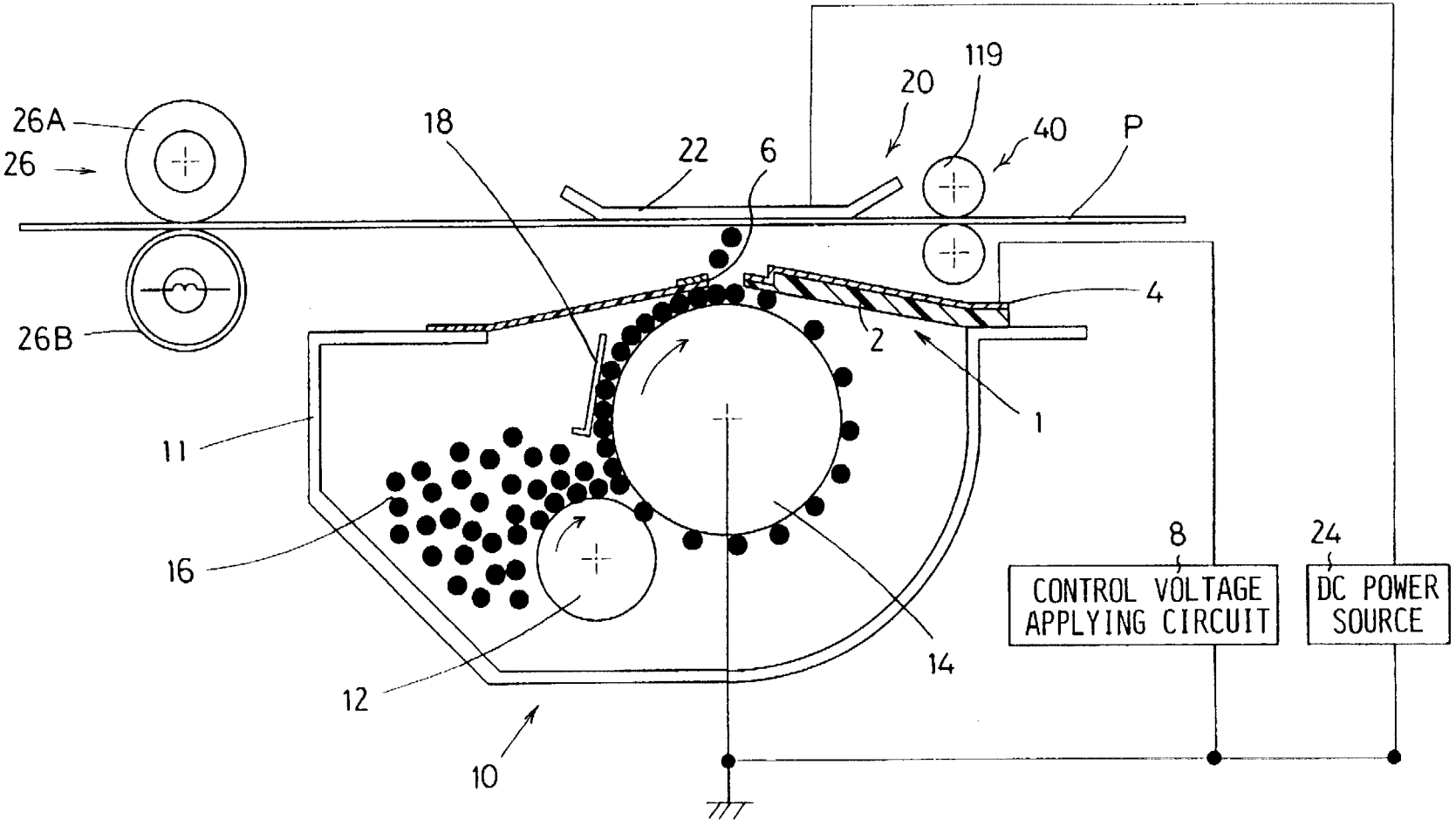
FIG. 1 is a partial schematic view showing a main portion of a first embodiment of an image forming apparatus of this invention.

Preferred embodiments according to this invention are described hereunder with reference to the accompanying drawings.

First, the construction of a main part of the image forming apparatus having an aperture electrode unit according to a first embodiment is described with reference to FIGS. 1 to 2.

The main part of the image forming apparatus mainly comprises a toner supply portion 10, a toner control portion 20 and a supporter feeding portion 40.

The toner supply portion 10 comprises a toner case 11 serving as a housing for the whole toner supply portion 10, toner 16 stocked in the toner case 11, a toner supply roller 12, a toner carry roller 14 and a toner-layer restricting blade 18.

The toner supply roller 12 is disposed inside of the toner case 11 to be rotatable in a direction as indicated by an arrow in FIG. 1. Through frictional contact with the toner 16 in the toner case 11, the toner supply roller 12 charges the toner 16 negatively, and attracts the charged toner 16 to the surface thereof.

The toner carry roller 14 is also disposed in the toner case 11 to be rotatable in a direction as indicated by an arrow and is disposed in contact with and in parallel to the toner supply roller 12. Accordingly, the toner carry roller 14 frictionally contacts the charged toner 16 that is fed while attached to the surface of the toner supply roller 12 and further charges the toner 16 negatively. The toner carry roller 14 further attracts the charged toner to the surface thereof to carry it thereon, and then feeds it toward the aperture electrode unit 1. The toner carry roller 14 is grounded.

The toner-layer restricting blade 18 is disposed in contact with the toner carry roller 14 under pressure. It serves to adjust the amount of the toner 16 carried on the surface of the toner carry roller 14 to be uniform on the roller surface and to uniformly charge the toner 16.

The toner control portion 20 includes an aperture electrode unit 1, a control voltage applying circuit 8, a back electrode 22 and a DC power source 24.

Figure 2:
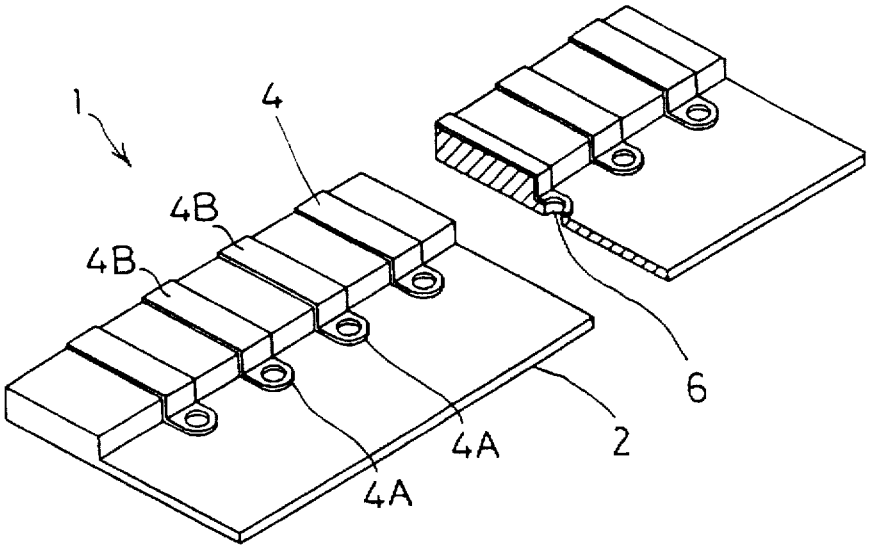
FIG. 2 is a perspective view showing the construction of an aperture electrode unit used in the image forming apparatus of the first embodiment.

As shown in FIG. 2, the aperture electrode unit 1 includes a polyimide insulating sheet 2 having a dielectric constant of substantially 3.5, which is designed in a stepped plate shape. The sheet 2 comprises a thin portion of about 15 μm thickness and a thick portion of about 50 μm thickness, plural apertures 6 of about 40 μm diameter which are arranged in a row in the longitudinal direction of the thin portion of the insulating sheet 2, and control electrodes 4 of about 1 μm thickness formed along the stepped portion of the insulating sheet 2 in correspondence with the respective apertures 6 to surround each aperture 6. Accordingly, the non-operating portions 4B of the control electrodes 4 that are positioned away from the apertures 6 are disposed at a higher position than the operating portions 4A of the control electrodes 4 in the neighborhood of the apertures 6. Further, as shown in FIG. 1, the non-operating portions 4B of the control electrodes 4 are disposed at a more downstream side of the apertures 6, that is, the non-operating portions 4A in a toner feeding direction of the toner carry roller 14.

The aperture electrode unit 1 is disposed so that the apertures 6 of the insulating sheet 2 are pressed against the toner carry roller 14 while the control electrodes 4 confront a supporter P being fed thereto.

Figure 3:
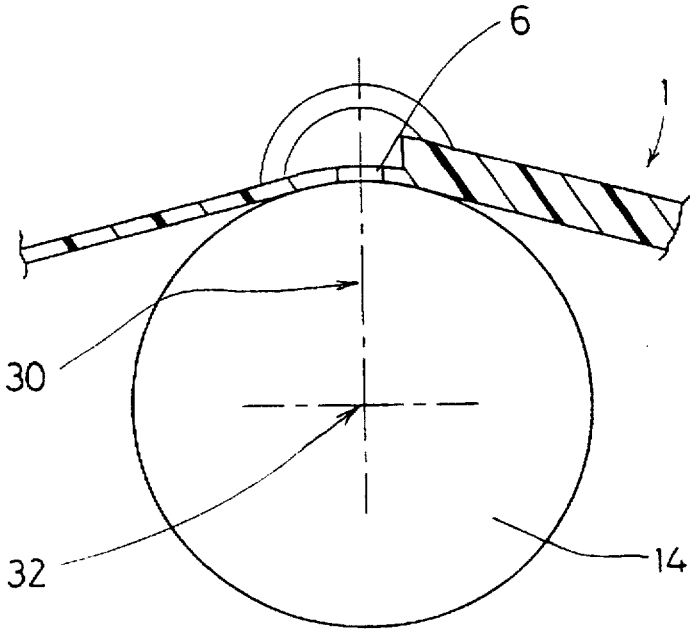
FIG. 3 schematically shows a positional relationship between the aperture electrode unit and the toner carry roller used in the image forming apparatus of the first embodiment.

Here, the detailed positional relationship between the apertures 6 of the aperture electrode unit 1 and the toner carry roller 14 are described with reference to FIG. 3. Each of the apertures 6 of the aperture electrode unit 1 is so disposed that the center axis 30 of each aperture 6 passes over the uppermost portion of the periphery of the toner carry roller 14 and the center axis 32 of the toner carry roller 14. Accordingly, each of the apertures 6 is disposed to be symmetrically at right and left sides with respect to the uppermost portion of the periphery of the toner carry roller 14, whereby the toner 16 passing through each aperture 6 can be uniformly distributed over the whole area of the aperture 6. Further, since the wall surface of the aperture 6 and the toner flow direction are parallel to each other, the toner 16 can stably flow through the aperture 6. In addition, the aperture electrode unit 1 itself is pressed against the toner carry roller 14 such that it can be substantially equiangularly bent to the right and left sides of the apertures 6 around the aperture array. With this construction, the contact area between the aperture electrode unit 1 and the toner carry roller 14 can be increased. In addition, those portions which surround the peripheries at the lower side of the apertures 6 can be pressed uniformly at the right and left sides. So, non-uniformity in recording density that would occur when an image is formed can be maximally prevented.

The control voltage applying circuit 8 is connected to the control electrodes 4 of the aperture electrode unit 1 and serves to selectively apply a voltage of 0V or +50V to the control electrodes 4 on the basis of the image data input from a data input portion, not shown in the figures. As described above, the toner carry roller 14 is grounded.

The substantially flat back electrode 22 is disposed to face the toner carry roller 14 through the apertures 6 of the aperture electrode unit 1. The back electrode 22 is disposed away from the aperture electrode unit 1 substantially at a 1 mm interval and is supported by a chassis (not show). Therefore, the apparatus is designed so that the supporter P is insertable into a gap between the back electrode 22 and the aperture electrode unit 1. The DC power source 24 is connected to the back electrode 22 and serves to apply a voltage of +1 kV to the back electrode 22.

The supporter feeding portion 40 includes a pair of feeding rollers 119 and a fixing device 26. The supporter P fed through an insertion port (not shown) is pinched by the pair of feeding rollers 119, passes over a locating position of the back electrode 22 serving as an image forming position, and is then fed to the fixing device 26. The fixing device 26 comprises a heat roller 26B having a heat source therein and a press roller 26A that is pressed against the heat roller 26B. The supporter P having an image formed thereon is pinched by the two rollers 26A and 26B in the fixing device 26, and the toner image is thermally fixed. Thereafter, the supporter P is discharged from the image forming apparatus through a discharge port (not shown).

Next, the operation of the image forming apparatus according to this embodiment is described with reference to FIGS. 1 and 2.

Upon input of an image forming command to the image forming apparatus, the toner carry roller 14 and the toner supply roller 12 first start their rotation in the direction as indicated by the arrows in FIGS. 1. Through this rotational motion of these rollers, the toner 16 fed from the toner supply roller 12 is rubbed against the surface of the toner carry roller 14 to be negatively charged. Then, it is carried on the surface of the toner carry roller 14. The toner 16 thus carried is thinned and uniformly charged by the toner-layer restricting blade 18 and then fed toward the aperture electrode unit 1 through the rotation of the toner carry roller 14. The toner 16 on the toner carry roller 14 is supplied to the lower side of the apertures 6 while being rubbed against the insulating sheet 2 of the aperture electrode unit 1.

At this time, those control electrodes 4 which correspond to an image-forming area are supplied with a voltage of +50V in accordance with an input image signal by the control voltage applying circuit 8. Consequently, an electric line of force is generated in the vicinity of the apertures 6 at the image-forming area due to potential difference between the control electrodes 4 and the toner carry roller 14. By this electric line of force, the negatively charged toner 16 is electrostatically attracted to a higher potential position, so that it is attracted from the surface of the toner carry roller 14 through the apertures 6 to the side of the control electrodes 4. The toner 16 that has reached the control electrodes side is further electrostatically attracted toward the supporter P by electric field formed between the supporter P and the aperture electrode unit 1 by the voltage of +1V applied to the back electrode 22. It is then deposited on the supporter P, thereby forming an image on the supporter P.

The control electrodes 4 corresponding to a non-image forming area are supplied with a voltage of 0V from the control voltage applying circuit 8. As a result, no electric line of force is formed between the toner carry roller 14 and the control electrodes 4. Thus, the toner 16 on the toner carry roller 14 suffers no electrostatic force, so that no toner 16 passes through the apertures 6.

The supporter P is fed in a direction perpendicular to the aperture array direction by a distance corresponding to one picture element by the supporter feeding portion 40 while one array of picture elements are formed on the surface of the supporter P with the toner 16. Through the repetitive operation as described above, a toner image is formed on the whole surface of the supporter P. Then, the formed toner image is fixed on the supporter P by the fixing device 26.

Finally, the supporter P having the toner image formed thereon is discharged through the discharge port (not shown) to the outside of the image forming apparatus.

According to the aperture electrode 1 of this embodiment, the distance between the control electrodes 4 and the toner carry roller 14 is short at only the operating portions 4A that are located in the vicinity of the apertures 6 and serve to form an electric field for producing toner flow and is long at the non-operating portions 4B that correspond to the wiring portions. Accordingly, a strong electric field, which is capable of controlling the charged toner 16, can be formed between the operating portions 4A of the control electrodes 4 and the toner carry roller 14. On the other hand, no strong electric field capable of controlling the charged toner 16 is formed between the non-operating portions 4B of the control electrodes 4 and the toner carry roller 14. That is, a slightly weak electric field is formed between the non-operating portions 4B of the control electrodes 4 and the toner carry roller 14. However, the charged toner 16 cannot be controlled by such a weak electric field. As a result, the toner 16 on the toner carry roller 14 is not attached onto the insulating sheet 2, and there is no disadvantage as described above. Further, in the image forming apparatus of this embodiment, since the control electrodes 4 of the aperture electrode unit 1 are disposed so that the non-operating portions 4B thereof are disposed at the downstream side of the rotational direction of the toner carry roller 14, that is, the feeding direction of the toner 16, the toner 16 suffers no effect of the electric field before being supplied to the apertures 6. Accordingly, this image forming apparatus can provide a high-quality image.

Further, the supporter P is fed in a direction perpendicular to the aperture array direction by a distance corresponding to one picture element while an array of picture elements are formed with the toner 16 on the surface of the supporter P. By repetitively carrying out the above process, the toner image is formed on the whole surface of the supporter P. Thereafter, the formed toner image is fixed onto the supporter P by the fixing device 26.

If insulating toner is used as the toner 16 in the image forming apparatus as described above, electrical insulation is substantially perfectly kept between the toner carry roller 14 and the control electrodes 4. Thus, there is no possibility that the apertures 6 would be broken down.

In the above process, the control electric field of the control electrodes 4 is formed inside of the control electrodes 4 and the apertures 6 and in the gap between the apertures 6 and the toner carry surface of the toner carry roller 14 that faces the apertures 6. Accordingly, the control electric field can be directly applied to the carried toner 16. Thus, a control efficiency of the toner flow is very high.

Further, even when a part of the supplied toner 16 invades into the apertures 6 corresponding to the non-image forming area due to a mechanical force applied to the toner 16 through the rubbing between the toner 16 and the aperture electrode unit 1, the toner 16 can be controlled not to pass through the apertures 6 by the electric field inside of the apertures 6. So, the control of the toner flow can be excellently performed.

Still further, since the toner carry roller 14 and the aperture electrode unit 1 confront each other through the toner layer, these elements can be disposed at a relatively short distance. Thus, the control voltage can be lowered, and an inexpensive driving element can be used.

Since the insulating sheet 2 of the aperture electrode unit 1 is disposed to face the toner carry roller 14, the control electrodes 4 and the toner carry roller 14 are prevented from being electrically short-circuited through their contact even when no toner 16 exists on the toner carry roller 14 due to failure of the toner supply system. So, the driving element can be prevented from being broken down.

Further, the aperture electrode unit 1 and the toner 16 on the toner carry roller 14 contact each other at the entrance portions of the apertures 6. Thus, the toner 16 deposited at the entrance portions of the apertures 6 are pushed out by the toner 16 successively supplied by the toner carry roller 14. So, the apertures 6 can be prevented from being clogged due to deposition and bridging of the toner 16 at the entrance portions of the apertures 6.

This invention is not limited to the above embodiment, and various modifications may be made without departing from the subject matter of this invention.

For example, in the above embodiment, the wirings of the control electrodes 4 are provided at only one side surface of the insulating sheet. However, these wirings may be made at both side surfaces of the insulating sheet 2. In this case, the insulating sheet of the aperture electrode unit 1 may be designed to be thin at only the aperture side thereof and thick at the wiring side thereof.

Further, in the above embodiment, the control voltage to be applied for the apertures 6 corresponding to the non-image forming portion is set to 0V. However, it may be set to a negative voltage. In this case, the toner 16 in the vicinity of the apertures 6 corresponding to the non-image forming portion is electrostatically attracted to the toner carry roller 14. Thus, the possibility that the toner 16 is passed through the apertures 6 is further reduced. Accordingly, an image can be obtained with higher image quality.

Still further, in the above embodiment, an aperture electrode unit 1 is used as the toner flow control means. However, a mesh-shaped electrode unit as disclosed in U.S. Pat. No. 5,036,341 may be used as the toner flow control means.

Figure 4A:
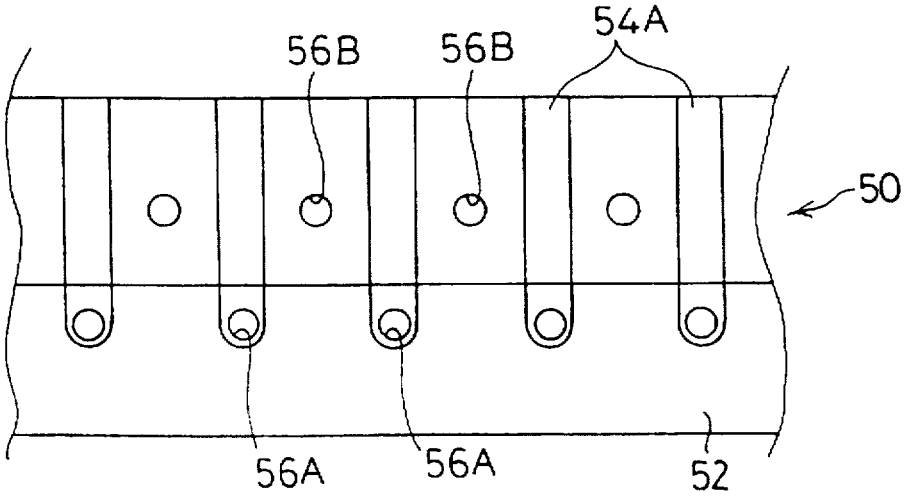
FIG. 4A is a partial top view showing the construction of an aperture electrode unit of a second embodiment.
Figure 4B:
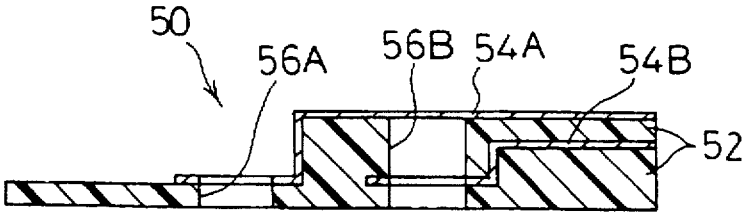
FIG. 4B is a cross-sectional side view showing the construction of the aperture electrode unit of the second embodiment.

When the wiring portions of the control electrodes 4 are concentratively disposed at the downstream side of the toner feeding direction like the embodiment as described above, blurring of an image, attachment of the toner to the non-image forming portion and unevenness of image density can be greatly reduced. However, it is difficult to keep a space for the wirings. In order to solve this problem, an aperture electrode unit 50 as shown in FIGS. 4A and 4B may be used.

This aperture electrode unit 50 comprises an insulating sheet 52, control electrodes 54A and 54B and apertures 56A and 56B. In this aperture electrode unit 50, the control electrodes 54A are provided on the upper surface of the insulating sheet 52, and the control electrodes 54B are provided inside of the insulating sheet 52. The wirings are designed in a multilayered structure. In this case, the apertures 56A and 56B are arranged in a staggered form. With this arrangement, the space for the wirings can be maintained, and also an image can be obtained with high resolution.

Figure 5:
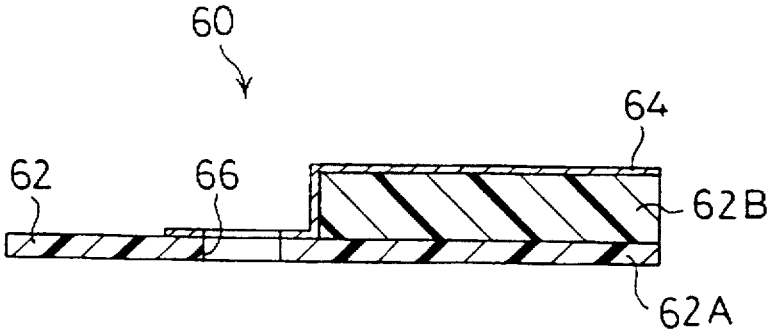
FIG. 5 is a cross-sectional side view showing the construction of an aperture electrode unit of a third embodiment.

Further, an aperture electrode unit 60 as shown in FIG. 5 may be used. The aperture electrode unit 60 comprises a polyimide insulating sheet 62, control electrodes 64 and apertures 66. The insulating sheet 62 is designed in a double-layer structure, which comprises a thin insulating sheet 62A and a thick insulating sheet 62B. In this case, the thick insulating sheet 62B may be formed of the same material as the insulating sheet 62A or may be formed of different insulating material such as different resin or ceramic. If the insulating sheet 62B is formed of material having higher capability of shielding the electric field than the insulating sheet 62A, that is, material having lower dielectric constant than the insulating sheet 62A, a higher effect could be obtained. As a material having a lower dielectric constant than polyimide, which has a dielectric constant of substantially 3.5, the following may be used: vinyl chloride resin such as polyvinyl dichloride, styrene resin, AS resin, ABS resin, methacrylic resin, copolymer of methacryl and styrene, polyethylene, copolymer of ethylene and vinyl acetate, polypropylene, polypropylene copolymer, polypropylene/glass fiber, polypropylene inactivation, iomoner resin, polytetrafluoroethylene, glass fiber, polycarbonate, polycarbonate/glass fiber, polyphenylene, polyphenylene•oxide, polyphenylene•oxide•glass fiber, methylpenten resin, polyether chloride or the like. However, if the insulating sheet 62B is a spaced portion, its dielectric constant is substantially 1.0, and thus a higher effect could be obtained if a spaced portion is used in place of the insulating sheet 62B or if a foaming member containing a large amount of air is used in place of the insulating sheet 62B.

Figure 6:
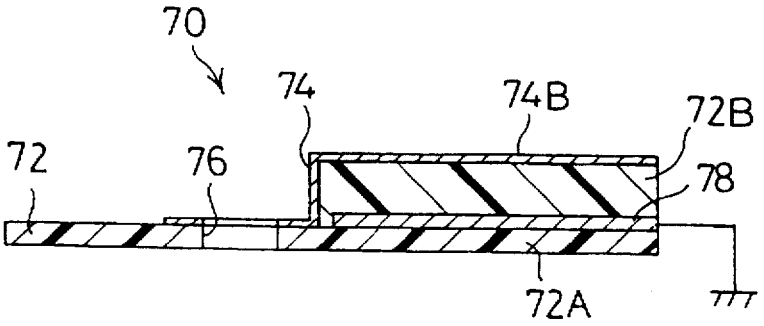
FIG. 6 is a cross-sectional side view showing the construction of an aperture electrode unit of a fourth embodiment.

Further, an aperture electrode unit 70 as shown in FIG. 6 may be used. The aperture electrode unit 70 comprises a polyimide insulating sheet 72, control electrodes 74, apertures 76 and a grounded shielding electrode 78. The insulating sheet 72 is designed in a double-layer structure, which comprises a thin insulating sheet 72A and a thick insulating sheet 72B like the insulating sheet 62 as described above. The shielding electrode 78 is disposed between the thin insulating sheet 72A and the thick insulating sheet 72B. In this case, since the shielding electrode 78 is disposed between the thin and thick insulating sheets 72A and 72B, the aperture electrode unit 70 can be easily manufactured. If the shielding electrode 78 is connected to a constant-voltage source, it has an electric field shielding effect, it may be designed not to be grounded, but rather to be connected to the constant-voltage source. However, in this embodiment, the shielding electrode 78 is grounded as the lowest cost structure. Further, the insulating sheet 72B may be formed of the same material as the insulating sheet 72A. If the insulating sheet 72B is formed of material having higher capability of shielding electric field than the insulating sheet 72A, that is, a material having a lower dielectric constant than the insulating sheet 72A, a higher effect can be obtained. As a material having a lower dielectric constant than polyimide, which has a dielectric constant of substantially 3.5, the following may be used: vinyl chloride resin such as polyvinyl dichloride, styrene resin, AS resin, ABS resin, methacrylic resin, copolymer of methacryl and styrene, polyethylene, copolymer of ethylene and vinyl acetate, polypropylene, polypropylene copolymer, polypropylene/glass fiber, polypropylene inactivation, iomoner resin, polytetrafluoroethylene, glass fiber, polycarbonate, polycarbonate/glass fiber, polyphenylene, polyphenylene•oxide, polyphenylene•oxide•glass fiber, methylpenten resin, polyether chloride or the like. However, if the insulating sheet 62B is a spaced portion, its dielectric constant is substantially 1.0. Thus, a higher effect could be obtained if a spaced portion is used in place of the insulating sheet 62B or if a foaming member containing a large amount of air is used in place of the insulating sheet 62B.

The insulating sheet 72 may be formed integrally. In this case, the shielding electrode 78 is designed to be embedded into the lower portion of a non-operating portion 74B of a control electrode 74. With this construction, an electric field that would occur between the non-operating portion 74B and the toner carry roller 14 can be shielded by the shielding electrode 78 to prevent occurrence of such an electric field when the aperture electrode unit 70 is applied to the image forming apparatus as described above.

Figure 7A:
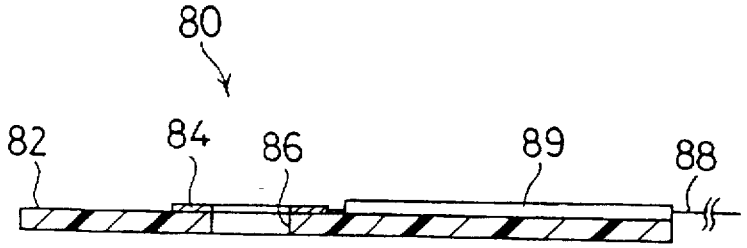
FIG. 7A is a cross-sectional side view showing the construction of an aperture electrode unit of a fifth embodiment.
Figure 7B:
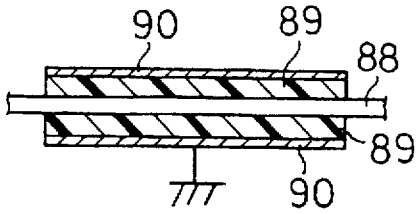
FIG. 7B is a cross-sectional partial side view showing the construction of the aperture electrode unit of the fifth embodiment.

Further, in the embodiment as described above, the wirings of the control electrodes 4 are directly formed on the insulating sheet 2. However, an aperture electrode unit 80 having a wiring arrangement as shown in FIG. 7A may be used. This aperture electrode unit 80 comprises an insulating sheet 82 having a substantially flat shape, control electrodes 84 and apertures 86. Each of the control electrodes 84 is provided at only the periphery of each aperture 86, and a wiring 88 is provided to each control electrode 84. These wirings 88 are coated with an insulating member 89 having high electric field shielding effect. For example, as the material of the insulating members 89, the following may be used: vinyl chloride resin such as polyvinyl dichloride, styrene resin, AS resin, ABS resin, methacrylic resin, copolymer of methacryl and styrene, polyethylene, copolymer of ethylene and vinyl acetate, polypropylene, polypropylene copolymer, polypropylene/glass fiber, polypropylene inactivation, iomoner resin, polytetrafluoroethylene, glass fiber, polycarbonate, polycarbonate/glass fiber, polyphenylene, polyphenylene•oxide, polyphenylene•oxide•glass fiber, methylpenten resin, polyether chloride or the like as described above. Further, a foaming member containing a large amount of air may be used. Accordingly, when the aperture electrode unit 80 is applied to the image forming apparatus as described above, an electric field is hardly formed between the wirings 88 and the toner carry roller 14, and the same effect as the other embodiments can be obtained. Further, as shown in FIG. 7B, the wirings 88 coated with the insulating member 89 may be further coated with a grounded shielding member 90. In this case, the shielding member 90 provides the same effect as the shielding electrode 78 shown in FIG. 6. Further, in this case, the shielding member 90 could have the electric field shielding effect if it is connected to a constant voltage source. Therefore, it may be designed not to be grounded, but to be connected to the constant voltage source. However, in this embodiment, as the lowest cost structure, the shielding member 90 is grounded.

The wirings 88 are disposed along the insulating sheet 82. However, they may be disposed in a direction vertical to the insulating sheet 82, that is, in an upward direction from the apertures 86.

Figure 8:
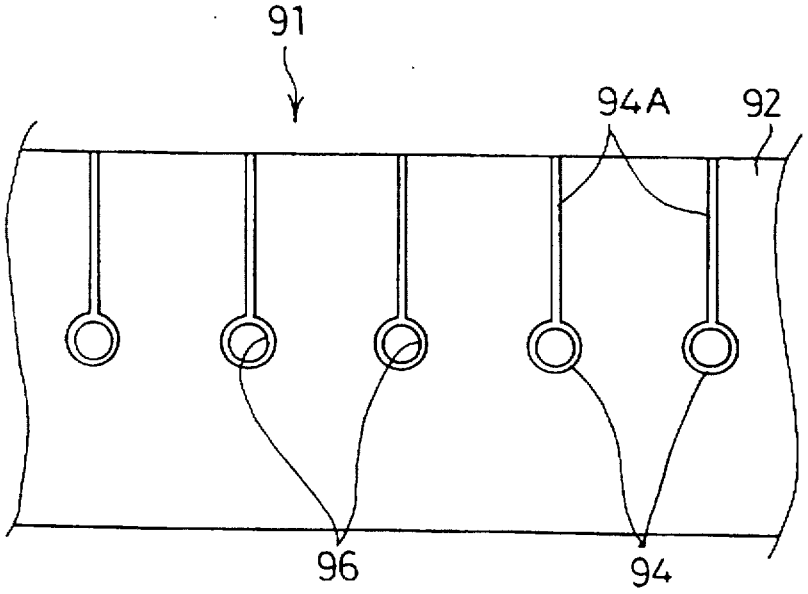
FIG. 8 is a partial top view showing the construction of an aperture electrode of a sixth embodiment.
Figure 9:
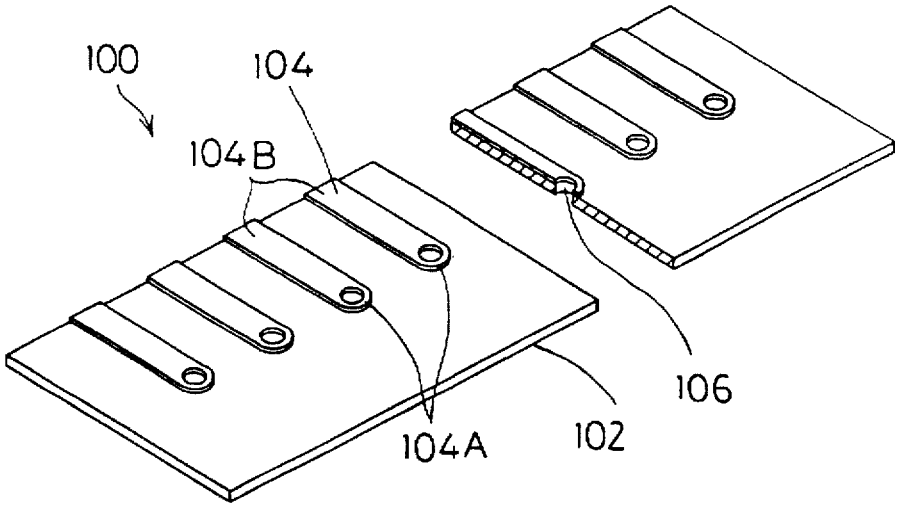
Fig.9 RELATED ART
FIG. 9 is a perspective view showing the construction of an aperture electrode unit of a conventional image forming apparatus.

Further, an aperture electrode unit 91 as shown in FIG. 8 may be used. The aperture electrode unit 91 comprises an insulating sheet 92 having a substantially flat plate, control electrodes 94 and apertures 96. Each of the control electrodes 94 is provided to surround each of the apertures 96, and extremely slender wirings 94A are provided to extend from the control electrodes 94. The width of the wirings 94A is set to substantially 8 μm. The wirings are designed to have a width which is equal to or smaller than the average diameter 10 μm of toner particles used in this embodiment. However, if the average toner particle diameter of used toner has a different value, the width of the wirings is preferably below the average toner particle diameter.

Accordingly, when the aperture electrode unit 91 is applied to the image forming apparatus as described above, an electric field is hardly formed between the wirings 94A and the toner carry roller 14, and the same effect as the other aperture electrode unit can be obtained. Further, such extremely slender wirings may be used for the other aperture electrode units as well as the above aperture electrode unit.

In the above embodiments, the polyimide insulating sheet is used, however, a different kind of insulating member may be used.

What is claimed is:

1. An image forming apparatus for forming an image with toner on a supporter comprising:

toner supply means for supplying charged toner to the image supporter;

toner flow control means for controlling flow of the charged toner from the toner supply means to the supporter, the toner flow control means having a first side and a second side, wherein the first side contacts the toner supply means, the toner flow control means including apertures for passage of the charged toner and control electrodes disposed on the second side adjacent to each of the apertures, each of the control electrodes comprising a first portion and a second portion;

voltage supply means electrically connected to the control electrodes for applying a control voltage to said control electrodes to form an electric field near each of the apertures to control passage of the charged toner; and shielding means disposed adjacent to the second portion of the control electrodes for shielding the electric field formed between the second portion of each of the control electrodes and the toner supply means, wherein only the first portion contributes to formation of the electric field for controlling the toner flow when the control voltage is applied to the control electrodes by the voltage supply means, and the second portion is shielded from forming the electric field capable of controlling the toner flow by the shielding means, and wherein the toner flow control means includes a first insulating flat plate for mounting the control electrodes thereon, and the shielding means comprises a second insulating flat plate disposed on the first insulating flat plate provided between the second portions of the control electrodes and the toner supply means, the second insulating flat plate comprising a layer having a low dielectric constant that is equal to or lower than a dielectric constant of the first insulating flat plate.

2. An image forming apparatus for forming an image with toner on a supporter comprising:

toner supply means for supplying charged toner to the image supporter;

toner flow control means for controlling flow of the charged toner from the toner supply means to the supporter, the toner flow control means having a first side and a second side, wherein the first side contacts the toner supply means, the toner flow control means including apertures for passage of the charged toner and control electrodes disposed on the second side adjacent to each of the apertures, each control electrode comprising a first portion and a second portion;

voltage supply means electrically connected to the control electrodes for applying a control voltage to said control electrodes to form an electric field near each of the apertures to control passage of the charged toner; and shielding means disposed adjacent to the second portion of the control electrodes for shielding the electric field formed between the second portion of each of the control electrodes and the toner supply means, wherein only the first portion contributes to formation of the electric field for controlling the toner flow when the control voltage is applied to the control electrodes by the voltage supply means, and the second portion is shielded from forming the electric field capable of controlling the toner flow by the shielding means, and wherein the toner flow control means includes an insulating flat plate for mounting the control electrodes, and the second portions of the control electrodes are coated with low dielectric constant material having a dielectric constant equal to or lower than a dielectric constant of the insulating flat plate.

3. The image forming apparatus as claimed in claim 2, wherein the second portions are coated with a shielding member to which a constant voltage is applied.

4. The image forming apparatus as claimed in claim 3, wherein the shielding member is grounded.

5. An image forming apparatus for forming an image with toner on a supporter comprising:

toner supply means for supplying charged toner to the image supporter;

toner flow control means for controlling flow of the charged toner from the toner supply means to the supporter, the toner flow control means having a first side and a second side, wherein the first side contacts the toner supply means, the toner flow control means including apertures for passage of the charged toner and control electrodes disposed on the second side adjacent to each of the apertures, each control electrode comprising a first portion and a second portion;

voltage supply means electrically connected to the control electrodes for applying a control voltage to said control electrodes to form an electric field near each of the apertures to control passage of the charged toner; and shielding means disposed adjacent to the second portion of each of the control electrodes for shielding the electric field formed between the second portion of each of the control electrodes and the toner supply means, wherein only the first portion contributes to formation of the electric field for controlling the toner flow when the control voltage is applied to the control electrodes by the voltage supply means, and the second portion is shielded from forming the electric field capable of controlling the toner flow by the shielding means, wherein the toner flow control means comprises an insulating sheet having two opposed sides and including a thin portion and a thick portion, the control electrodes being electrically insulated from one another and coupled to the insulating sheet, and the apertures being provided in the insulating sheet respectively in correspondence with the control electrodes so as to penetrate through the insulating sheet and the control electrodes, and wherein each of the control electrodes has the first portion formed at the thin portion at one side of the insulating sheet and the second portion formed at the thick portion of the insulating sheet, and the toner supply means confronts the side of the insulating sheet opposed to the first portion.

6. A particle control apparatus for controlling a flow of charged particles comprising:

particle flow control means for controlling the flow of charged particles, the particle flow control means having a first side and a second side and having control electrodes disposed on said second side, each control electrode comprising a first portion and a second portion;

charged particle supply means for supplying the charged particles to said particle flow control means, wherein said charged particle supply means contacts said first side of said particle flow control means;

voltage supply means for applying a control voltage to said control electrodes to form an electric field for controlling flow of the charged particles; and shielding means adjacent said second portion of each of said control electrodes for shielding the electric field formed between said second portion of each of said control electrodes and said charged particle supply means, wherein only said first portion contributes to formation of the electric field for controlling the flow of the charged particles and the second portion is shielded from forming the electric field capable of controlling the charged particle flow by the shielding means, wherein said particle flow control means includes a first insulating flat plate for mounting said control electrodes thereon, and said shielding means comprises a second insulating flat plate disposed on said first insulating flat plate between said second portions of said control electrodes and said particle supply means, and wherein said second insulating flat plate comprises a low dielectric constant layer having a dielectric constant equal to or lower than a dielectric constant of said first insulating flat plate.

7. A particle control apparatus for controlling a flow of charged particles comprising:

particle flow control means for controlling the flow of charged particles, the particle flow control means having a first side and a second side and having control electrodes disposed on said second side, each control electrode comprising a first portion and a second portion;

charged particle supply means for supplying the charged particles to said particle flow control means, wherein said charged particle supply means contacts said first side of said particle flow control means;

voltage supply means for applying a control voltage to said control electrodes to form an electric field for controlling flow of the charged particles; and shielding means adjacent said second portion of each of said control electrodes for shielding the electric field formed between said second portion of each of said control electrodes and said charged particle supply means, wherein only said first portion contributes to formation of the electric field for controlling the flow of the charged particles and the second portion is shielded from forming the electric field capable of controlling the charged particle flow by the shielding means, and wherein said charged particle flow control means includes an insulating flat plate for mounting said control electrodes, and said second portions of said control electrodes are coated with low dielectric constant material having a dielectric constant equal to or lower than a dielectric constant of said insulating flat plate.

8. The particle control apparatus as claimed in claim 7, wherein said second portions are coated with a shielding member to which a constant voltage is applied.

9. The particle control apparatus as claimed in claim 8, wherein said shielding member is grounded.

10. A particle control apparatus for controlling a flow of charged particles comprising:

particle flow control means for controlling the flow of charged particles, the particle flow control means having a first side and a second side and having control electrodes disposed on said second side, each control electrode comprising a first portion and a second portion;

charged particle supply means for supplying the charged particles to said particle flow control means, wherein said charged particle supply means contacts said first side of said particle flow control means;

voltage supply means for applying a control voltage to said control electrodes to form an electric field for controlling flow of the charged particles; and shielding means adjacent said second portion of each of said control electrodes for shielding the electric field formed between said second portion of each of said control electrodes and said charged particle supply means, wherein only said first portion contributes to formation of the electric field for controlling the flow of the charged particles and the second portion is shielded from forming the electric field capable of controlling the charged particle flow by the shielding means, wherein said charged particle flow control means comprises an insulating sheet with two opposed sides having a thin portion and a thick portion, the control electrodes being electrically insulated from one another and having the first portion formed at said thin portion at one side of said insulating sheet and the second portion at said thick portion, and the apertures being respectively provided in correspondence with said control electrodes so as to penetrate through said insulating sheet and said control electrodes, and wherein said insulating sheet confronts said charged particle supply means on the side opposed to the side on which said control electrodes are formed.

11. A charged particle control electrode for controlling flow of charged particles comprising:

an insulating sheet having a plurality of apertures extending therethrough, wherein said insulating sheet comprises a thick portion and a thin portion; and plural control electrodes electrically insulated from one another and positioned adjacent each aperture, wherein each control electrode comprises first portion formed at said thin portion of said insulating sheet and a second portion formed at said thick portion of said insulating sheet.

12. The charged particle control electrode as claimed in claim 11, wherein said insulating sheet comprises:

a first flat plate having an insulation characteristic; and a second flat plate having an insulation characteristic and having a surface area smaller than that of said first flat plate, said second flat plate being disposed on said first flat plate.

13. The charged particle control electrode as claimed in claim 12, further comprising a shielding electrode disposed between said first flat plate and said second flat plate, said shielding electrode being supplied with a constant voltage.

14. The charged particle control electrode as claimed in claim 13, wherein said shielding electrode is grounded.

15. The charged particle control electrode as claimed in claim 12, wherein said second flat plate is formed of material having a dielectric constant equal to or lower than a dielectric constant of said first flat plate.

16. The charged particle control electrode as claimed in claim 15, wherein said second flat plate comprises a material selected from the group consisting of vinyl chloride resin, polyvinyl dichloride, styrene resin, AS resin, ABS resin, methacrylic resin, copolymer of methacryl and styrene, polyethylene, copolymer of ethylene and vinyl acetate, polypropylene, polypropylene copolymer, polypropylene/glass fiber, polypropylene inactivation, iomoner resin, polytetrafluoroethylene, glass fiber, polycarbonate, polycarbonate/glass fiber, polyphenylene, polyphenylene•oxide, polyphenylene•oxide•glass fiber, methylpenten resin, and polyether chloride.

17. The charged particle control electrode as claimed in claim 15, wherein said second flat plate comprises a foam member.

18. The charged particle control electrode as claimed in claim 15, wherein said second flat plate comprises a spacer.

19. The charged particle control electrode as claimed in claim 11, wherein said second portions of said control electrodes have a width below an average diameter of the charged particles controlled thereby.

20. The charged particle control electrode as claimed in claim 11, wherein each of said control electrodes comprises a first control electrode disposed on the surface of said insulating sheet, and a second control electrode disposed within said insulating sheet, and wherein each of said apertures comprises a first aperture penetrating through said first control electrode and said insulating sheet, and a second aperture penetrating through said second control electrode and said insulating sheet.

21. An aperture electrode unit for controlling a flow of charged toner particles comprising:

an insulating sheet having a plurality of apertures therein, wherein the insulating sheet is a stepped plate including a first part and a second part, the first part being thinner than the second part; and a plurality of control electrodes coupled to the insulating sheet surrounding each of the apertures for connection to a power source to create an electric field to selectively control passage of charged toner particles through the apertures, wherein each of the control electrodes includes a first portion disposed directly adjacent to one of the plurality of apertures and a second portion spaced from the one aperture, the electric field being stronger in the first portion than in the second portion, wherein at least some of the apertures and the first portions of the respective control electrodes are disposed on the first part of the insulating sheet and the second portions of the control electrodes are disposed on the second part of the insulating sheet.

22. The aperture electrode unit of claim 21 wherein the second part of the insulating sheet includes an insulating spacer.

23. The aperture electrode unit of claim 22 wherein the insulating spacer has a lower dielectric constant than a dielectric constant of the first portion.

24. The aperture electrode unit of claim 22 wherein the insulating spacer comprises a material selected from the group consisting of vinyl chloride resin, polyvinyl dichloride, styrene resin, AS resin, ABS resin, methacrylic resin, copolymer of methacryl and styrene, polyethylene, copolymer of ethylene and vinyl acetate, polypropylene, polypropylene copolymer, polypropylene/glass fiber, polypropylene inactivation, iomoner resin, polytetrafluoroethylene, glass fiber, polycarbonate, polycarbonate/glass fiber, polyphenylene, polyphenylene•oxide, polyphenylene•oxide•glass fiber, methylpenten resin, and polyether chloride.

25. The aperture electrode unit of claim 22 wherein the insulating spacer is a foam member.

26. The aperture electrode unit of claim 21 wherein the insulating sheet includes a shielding electrode member disposed directly adjacent the second portions of the control electrodes.

27. The aperture electrode unit of claim 21 wherein the non-operating portions of the control electrodes are insulated.

28. The aperture electrode unit of claim 21 wherein the control electrodes are stepped with a surrounding portion surrounding an aperture adjacent the insulating sheet being the first portion and a second raised portion extending from the first portion being the second portion.

29. The aperture electrode unit of claim 21 wherein the plurality of apertures are arranged in staggered rows.

30. An aperture electrode unit for controlling a flow of charged toner particles comprising:

an insulating sheet having a plurality of apertures therein; and a plurality of control electrodes coupled to the insulating sheet surrounding each of the apertures for connection to a power source to create an electric field to selectively control passage of charged toner particles through the apertures, wherein each of the control electrodes includes a first portion disposed directly adjacent to one of the plurality of apertures and a second portion spaced from the one aperture, the electric field being stronger in the first portion than in the second portion, wherein the second portions of the control electrodes are formed of a slender wire having a width less than an average diameter of a charged toner particle.

* * * * *